US007740711B2

(12) United States Patent
Porter et al.

(10) Patent No.: US 7,740,711 B2
(45) Date of Patent: Jun. 22, 2010

(54) PARTS WASHER HEATER PUMP MODULE

(75) Inventors: Brian E. Porter, Addison, IL (US); Michael Endres, Woodridge, IL (US); Scott Biba, Highland, WI (US); Larry Gunseor, New Glarus, WI (US); Charles Younger, Greenfield, WI (US)

(73) Assignee: Safety-Kleen Systems, Inc., Plano, TX (US)

( * ) Notice: Subject to any disclaimer, the term of this patent is extended or adjusted under 35 U.S.C. 154(b) by 826 days.

(21) Appl. No.: 11/556,087

(22) Filed: Nov. 2, 2006

(65) Prior Publication Data

US 2008/0105285 A1 May 8, 2008

(51) Int. Cl.
*B08B 3/04* (2006.01)

(52) U.S. Cl. ..... 134/57 R; 134/56 R; 134/90; 134/108; 134/109; 134/111

(58) Field of Classification Search ..... 134/111, 134/108, 109, 56 R, 57 R, 90
See application file for complete search history.

(56) References Cited

U.S. PATENT DOCUMENTS

| | | | | |
|---|---|---|---|---|
| 3,522,814 | A | 8/1970 | Olson | |
| 5,213,119 | A * | 5/1993 | Kusz et al. | 134/95.3 |
| 5,232,299 | A | 8/1993 | Hiss | |
| 5,598,861 | A | 2/1997 | Danowski | |
| 5,720,308 | A * | 2/1998 | Danowski et al. | 134/111 |
| 5,827,374 | A | 10/1998 | Mansur | |
| 5,950,647 | A * | 9/1999 | Usher | 134/111 |
| 6,016,818 | A | 1/2000 | Evaro et al. | |
| 6,095,163 | A | 8/2000 | McClure | |
| 6,109,277 | A * | 8/2000 | Linton et al. | 134/56 R |
| 6,199,565 | B1 | 3/2001 | Bluestone | |
| 6,279,587 | B1 * | 8/2001 | Yamamoto | 134/57 R |
| 6,328,045 | B1 | 12/2001 | Strange | |
| 6,374,835 | B1 | 4/2002 | McClure et al. | |
| 6,398,877 | B1 * | 6/2002 | Magliocca | 134/10 |
| 6,440,226 | B2 | 8/2002 | McClure et al. | |
| 6,451,125 | B1 | 9/2002 | McClure et al. | |
| 6,571,810 | B1 | 6/2003 | McClure et al. | |
| 6,874,512 | B2 | 4/2005 | Publ et al. | |
| 2002/0170978 | A1 | 11/2002 | Mohn | |
| 2004/0200504 | A1 | 10/2004 | Publ et al. | |
| 2005/0012922 | A1 * | 1/2005 | Stierle et al. | 356/8 |
| 2005/0126592 | A1 | 6/2005 | Publ et al. | |

* cited by examiner

*Primary Examiner*—Michael Barr
*Assistant Examiner*—Benjamin Osterhout
(74) *Attorney, Agent, or Firm*—Vedder Price P.C.

(57) ABSTRACT

A parts washer including magnets located near a pump inlet to collect metallic particles suspended in the cleaning fluid; a casing to protect the pump mechanism from impact during handling; the pump oriented horizontally to take advantage of the separation of the cleaning fluid in successive vertical layers; two liquid level sensors to measure the level of the cleaning fluid in the reservoir; an evaporation control plate located at the interface between the reservoir and the receptacle of the reservoir to confine the vapor portion of the cleaning solution; protective handlebars placed next to the controls of a control module to protect the device from impact; and a pump motor control to provide a low flow rate of cleaning fluid using a pump without a variable regulator.

22 Claims, 6 Drawing Sheets

PARTS WASHER HEATER PUMP MODULE

FIELD OF THE DISCLOSURE

The present disclosure relates generally to improvements to an apparatus for washing parts, commonly called a "parts washer," using a cleaning fluid, including the use of magnets to collect metallic particles suspended in the cleaning fluid to protect a pump, two liquid level sensors, an evaporation control plate, handlebars or molded edges to protect the command controls of a control module, an improved pumping system with a pulsating flow to warn of low fluid level, a protective casing, and a pump vertically oriented with a vertical inlet or a horizontal pump with a plenum confined in the protective casing.

BACKGROUND

In many industries, such as the automotive industry, the machining industry, or other industries where parts are produced, used, and later serviced, parts removed from various machines and mechanisms often accumulate dirt or build-up in use. These parts may be covered with industrial products such as grease, paint, rust, or other elements and may require cleaning before they are reused or discarded. Industrial products, when washed in running water or in sinks connected to sewers, result in the release of industrial waste, which leads to environmental problems. These industrial wastes must often be collected and reused. Running water also has very limited utility as a cleaning fluid. Industrial solvents or other cleaning fluids, such as Safety Kleen 105 Recycled Solvent, Premium Gold Solvent, and aqueous based cleaners such as AQUA-WORKS® and ARMAKLEEN® of the Safety Kleen Corp., are known to improve parts cleaning when used in a parts washer. These solvents or cleaning agents, much like industrial waste, must often be collected.

Earlier versions of parts washers are described in U.S. Pat. Nos. 3,522,814, 4,049,551, 4,261,378, 5,598,861, 5,720,308, and 7,040,161, each of which is hereby fully incorporated herein by reference. These patents generally describe parts washers wherein a sink is positioned atop or within a barrel-type reservoir and in which a submersible pump is inserted. The pump circulates cleaning fluid from the reservoir to the interior of a sink, where parts are handled by an operator for washing and scrubbing. The sink is typically equipped with a light for better illumination and inspection of the parts to be washed and a drain with a large mesh filter to prevent large objects from falling from the sink into the reservoir.

While washing is being carried out by an operator, the cleaning fluid is pumped from the reservoir and continuously drains from the opening in the bottom of the sink back into the reservoir. Ordinary cleaning tools, such as brushes, rags, and other implements, can be fitted to the end of the tube through which the cleaning fluid is dispensed and can be used by the operator during the parts cleaning operation. Over the years, the most successful parts washers have been those that can be serviced readily and economically. One such parts washer is portable and can assembled manually at any location. A drum or reservoir is moved to a location, the frame of the device is attached to the back of the reservoir, and the sink is placed on the upper rim of the reservoir.

This type of device can be readily and economically serviced. The operation consists of changing the cleaning fluid by replacing the reservoir with a new drum, changing the filter, if any, and conducting a general machine cleanup by either cycling new cleaning fluid in the device using the pump or manually cleaning the different parts of the parts washer. In use, the cleaning fluid accumulates the waste covering the parts to be cleaned. The cleaning capacity of the cleaning fluid diminishes as waste elements accumulate in the cleaning fluid. With time, the cleaning fluid liquid level in the reservoir also diminishes due to splashing and/or evaporation.

Most cleaning fluids have better cleaning properties, such as degreasing, when they are kept at a raised temperature. Heated cleaning fluids also have lower viscosity and are better adapted to dissolving elements during cleaning. Parts washers may include a heating element in the reservoir to maintain the cleaning fluid at a selected operating temperature. The heating element may also be used to offset environmental temperature if the parts washer is used outdoors or building without climate controls. A temperature sensor is used to monitor the temperature of the cleaning fluid in the reservoir and regulate the heater. Service operations include replacing the heater, the pump, the control module, or any components thereof once they no longer operate adequately or have been damaged during operation.

The present disclosure involves the discovery that known parts washers, however successful, have several disadvantages that may be further improved upon. Some cleaning fluids may become volatile at high operating temperatures. Volatility of cleaning fluids due to evaporation also impacts the liquid level in the reservoir. These cleaning fluids are better used under controlled environments to protect operators from inhalation of fumes. Most known models of sinks are of square geometry, and most reservoirs, such as drums, have an upper rim of cylindrical geometry. Other reservoirs are rectangular in shape and a sink can be partly inserted into the reservoir. An opening can be created at the interface between the sink and the reservoir that allows the cleaning fluid to evaporate. What is needed is a parts washer capable of controlling evaporation at the interface between the sink and the reservoir.

Parts washers are also used in industrial settings or other environments where collisions and impacts are to be expected, such as where a control module is located behind the sink to protect the control elements and switches from impacts when loading and unloading the mechanical parts being washed. But since access to the control module is still possible, impacts to vulnerable components of the control module are likely to occur. Impacts are also likely to occur during the servicing process if the device is mishandled or dropped. A site worker inadvertently bumping or striking the parts washer with, for instance, a piece of wood, can permanently damage the control module and/or destroy a series of control buttons on a face of the control module. What is needed is a system designed to offer delicate elements protection from impact.

Another important feature of parts washers is the liquid level of cleaning fluid within the reservoir. Once the liquid level descends below a certain threshold, not only is the pump unable to draw the cleaning fluid but the time between two consecutive cycles of use of the cleaning fluid in the work area in the sink decreases. When the reservoir is full, the cleaning fluid may, for example only, cycle into the sink every hour based on the rate and quantity of cleaning fluid pumped from the reservoir. But if the liquid level is low, the same cleaning fluid may be cycled every few minutes, precipitating the rate at which the cleaning fluid is dirtied. Current parts washers use a single liquid level detector to monitor the level of cleaning fluid in the reservoir. The detection and measurement of used cleaning fluid before it must be rejuvenated is inherently difficult and uncertain. What is needed is an improved device to measure with precision the liquid level in the reservoir.

Parts washer also rely on a pump system to circulate the cleaning fluid from the reservoir to the sink. Pumps must transport cleaning fluid that is progressively soiled by dirt, oil, or other waste suspended in the fluid. Much like the parts to be cleaned, inner sections of the pumping system, such as valves and filters, can accumulate debris, which may lead to the need for replacement of the pump and its main components. Often, foreign bodies and other sediments settle in successive layers in the reservoir. Current parts washers are equipped with horizontal pumps with part of the inlet drawing from the bottom of the reservoir at a horizontal angle in a zone where greater concentration of debris is to be anticipated. These pumps are also vulnerable to impact when the parts washer is disconnected from the reservoir during maintenance, storage, and handling. What is needed is a parts washer with an improved pump system able to filter out part of the debris in suspension using stratification properties of the cleaning fluid to protect the pump and collect debris of a size sufficient to damage the pump before the debris reaches the inner conduits of the pump while being able to pass cleaning fluid through the pump.

SUMMARY

The present disclosure relates generally to improvements to an apparatus for washing parts, called commonly a "parts washer," using a cleaning fluid, including the use of magnets located near a pump inlet to collect metallic particles suspended in the cleaning fluid; a casing to protect the pump mechanism from impact during handling and to serve as plenum; a pump horizontally oriented or in a vertical configuration with a horizontal inlet in a plenum to take advantage of the sedimentation of waste in the cleaning fluid in successive vertical layers; two liquid level sensors to measure the level of the cleaning fluid in the reservoir; an evaporation control plate located at the interface between the reservoir and the sink to confine the vapor portion of the cleaning fluid; protective handlebars or a molded edge in a control module casing placed next to the controls of the control module to protect the device from impact; and a pump that uses a pulsating flow to warn the operator of low fluid level during operation.

BRIEF DESCRIPTION OF THE DRAWINGS

The features of the present disclosure are believed to be novel and are set forth with particularity in the appended claims. The disclosure may be best understood by reference to the following description taken in conjunction with the accompanying drawings. Figures that employ like reference numerals identify like elements.

DETAILED DESCRIPTION

The improved parts washer of the present disclosure is primarily for use in connection with parts washing operations in commercial and industrial applications. The present disclosure relates generally to improvements to an apparatus for washing parts, called commonly a "parts washer," using a cleaning fluid. While the hereafter proposed improvements constitute genuine improvements over the prior art, they cannot be construed in any way, shape, or form as limiting any of the novel and inventive subject matter previously disclosed and incorporated herein by reference. The new and novel inventive features described hereafter are nonobvious improvements over these references and also should not be reviewed with the benefit of hindsight. Since previous patents relating to parts washer are hereby incorporated by reference, conflicting or additional disclosure herein relating to elements must be construed when possible as coherent and additional disclosure. In the case of conflicting disclosure, this disclosure is to be given specific meaning and the incorporated disclosures shall be given general meaning when possible.

The present disclosure relates generally to improvements to an apparatus for washing parts using a cleaning fluid, including but are not limited to magnets located near a pump inlet to collect metallic particles suspended in the cleaning fluid, the magnets placed in one preferred embodiment outside of the casing; a casing to protect the pump mechanism from impact during handling and to create a plenum space between the pump and the casing; a horizontal orientation of the pump and/or of the pump inlet to take advantage of the sedimentation of debris in the cleaning fluid; the use of two liquid level sensors to measure the level of the cleaning fluid in the reservoir; an evaporation control plate located at the interface between the reservoir and the receptacle to confine the vapor portion of the cleaning solution within the reservoir; two protective handlebars placed next to the controls of a control module or a molded edge in the control module casing to protect the device from impact; and a pulsating flow pump to warn a user of a low fluid level within the reservoir.

Figure 1:
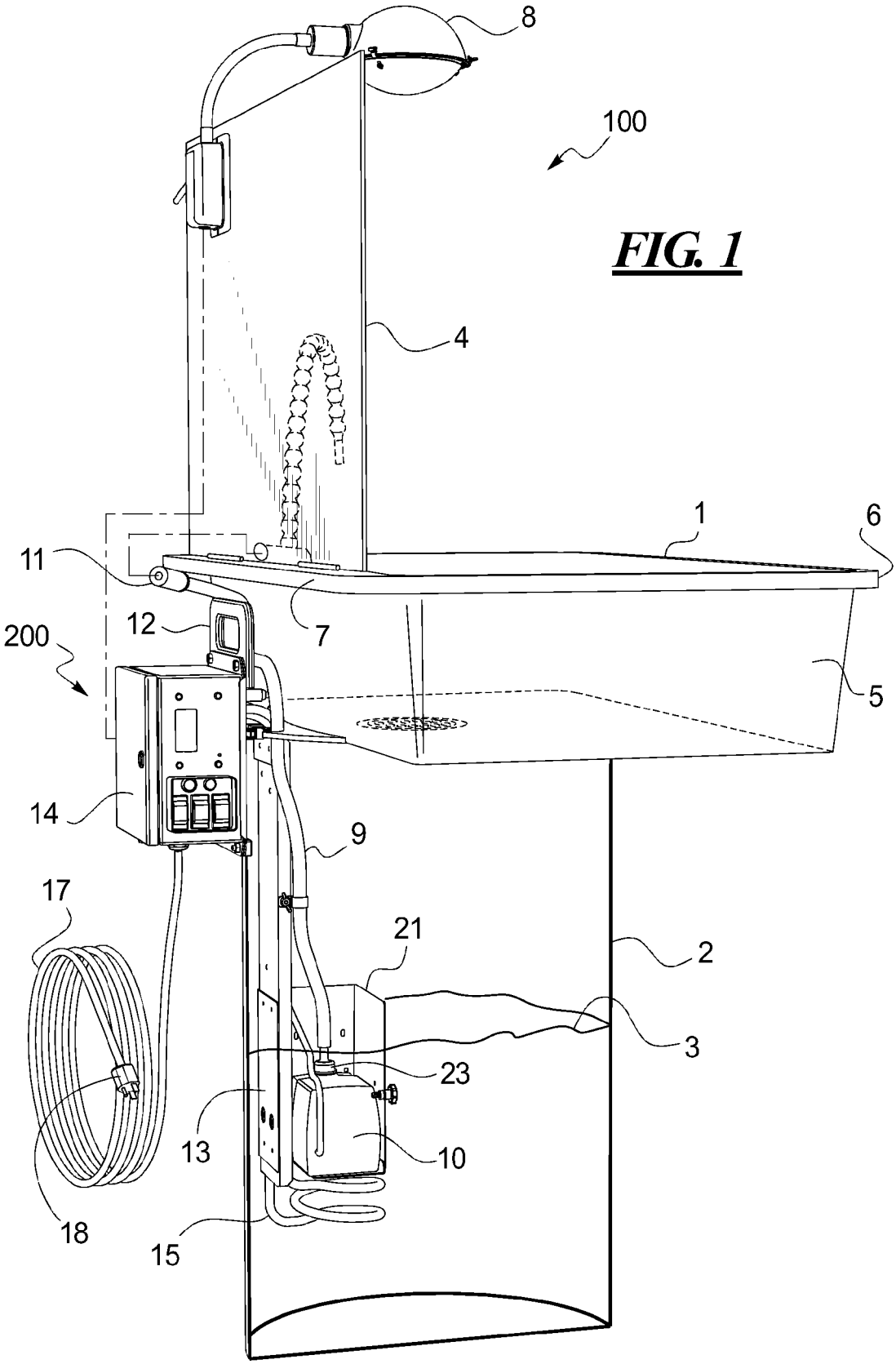
FIG. 1 is a perspective view of an improved parts washer constructed in accordance with an embodiment of the present disclosure.

FIG. 1 shows a perspective view of the improved parts washer 100 constructed in accordance with an embodiment of the present disclosure. The parts washer 100 is used for washing mechanical parts and may include a receptacle 1 connected on a reservoir 2 for containing a cleaning fluid 3, a drain opening (not shown) defined in the receptacle 1 for fluid communication between the receptacle 1 and the reservoir 2, and what is described as a whole as an improved parts washer module 200. In one possible configuration, a user (not shown) may carry or transport with the aid of a mechanical device the receptacle 1, the reservoir 2, and the parts washer module 200 to a worksite where parts are cleaned using the parts washer 100. The parts washer 100 is connected using an electrical cable 17 to a power outlet (not shown). The use of electrical power as a power source after inserting a power plug 18 into an electrical outlet (not shown) is known. What is also known is the use of transformers and power distribution within the parts washer to provide power to each element requiring power, such as but not limited to a heating element 15, a pump 10, a control module 14, and a lamp 8.

Figure 2:
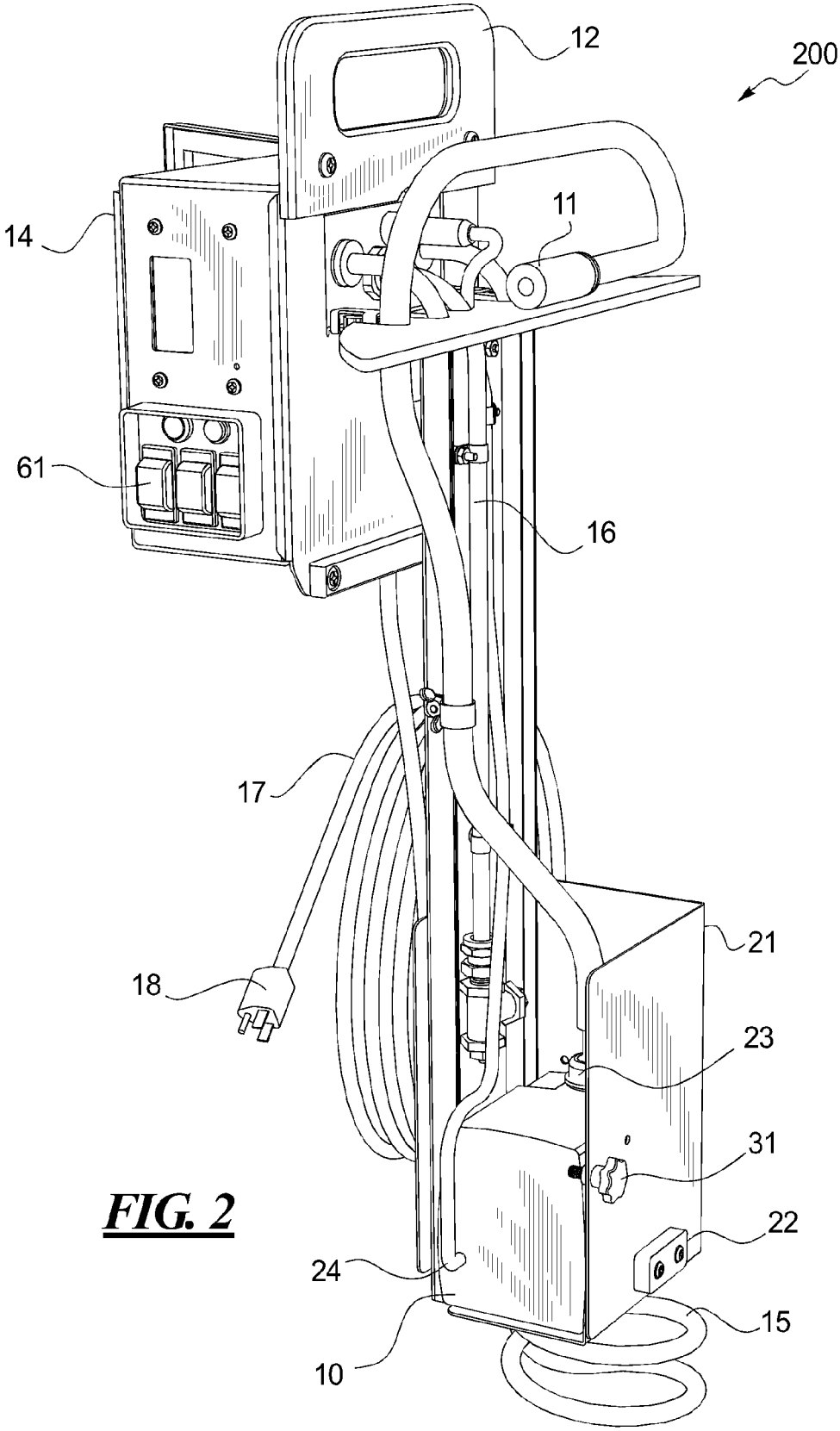
FIG. 2 is a perspective view of the improved parts washer module as shown in FIG. 1 according to a first embodiment of the present disclosure with a pump having a horizontal inlet and a vertical outlet next to a plenum.
Figure 3:
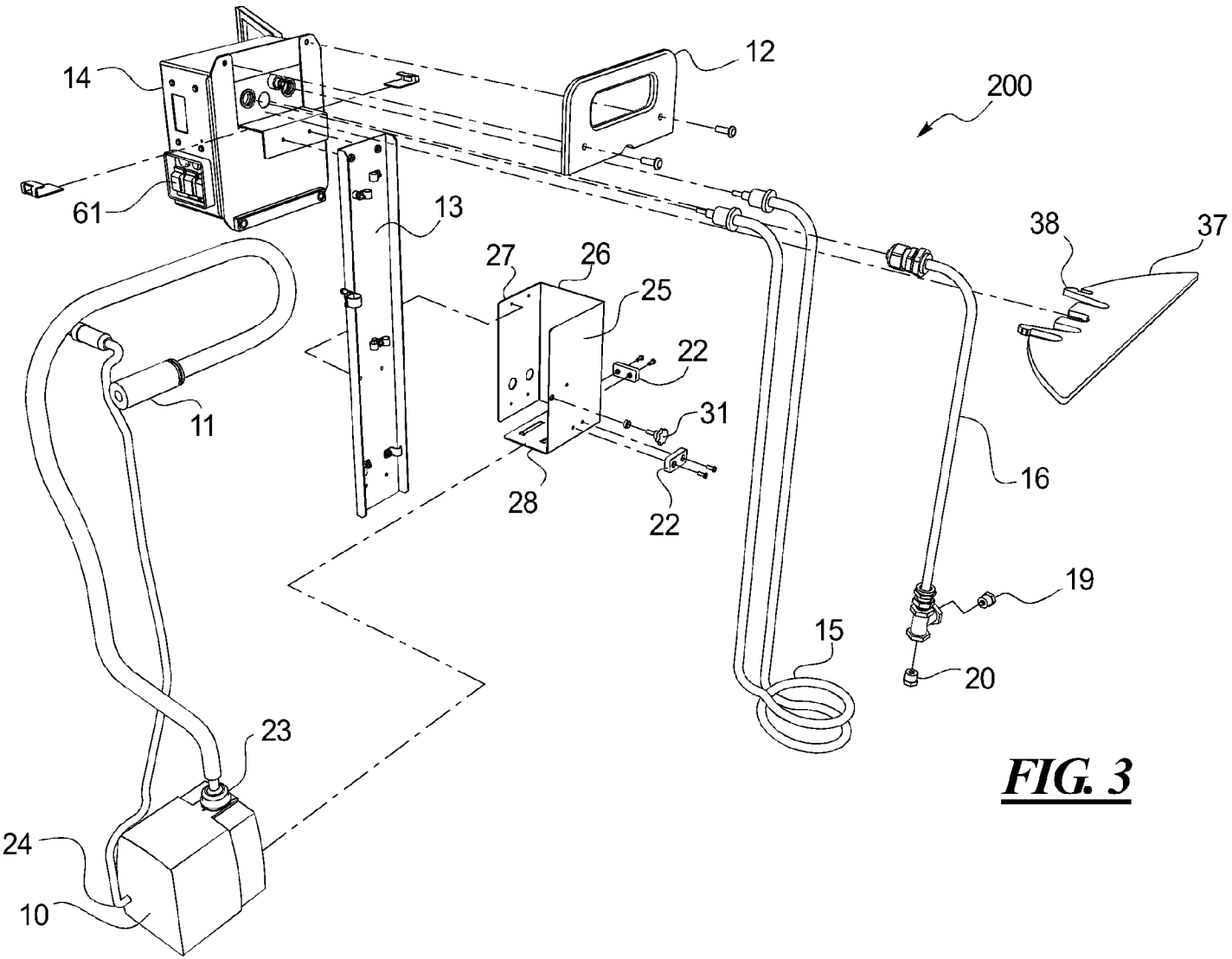
FIG. 3 is an exploded perspective view of the improved parts washer module as shown in FIG. 2 according to a first embodiment of the present disclosure.

The parts washer module 200 as shown in FIG. 1 may include a control module 14, a handle 12, a frame 13, a pump 10, a heating element 15, and their associated mechanical, functional, and electrical connections as described hereafter. In other embodiments, the parts washer module 200 may also include a liquid level detector 16 as shown in FIGS. 2 and 3, a first sensor 19, a second sensor 20, and a protective guard 21 for the pump 10 or the magnets 22.

Figure 6:
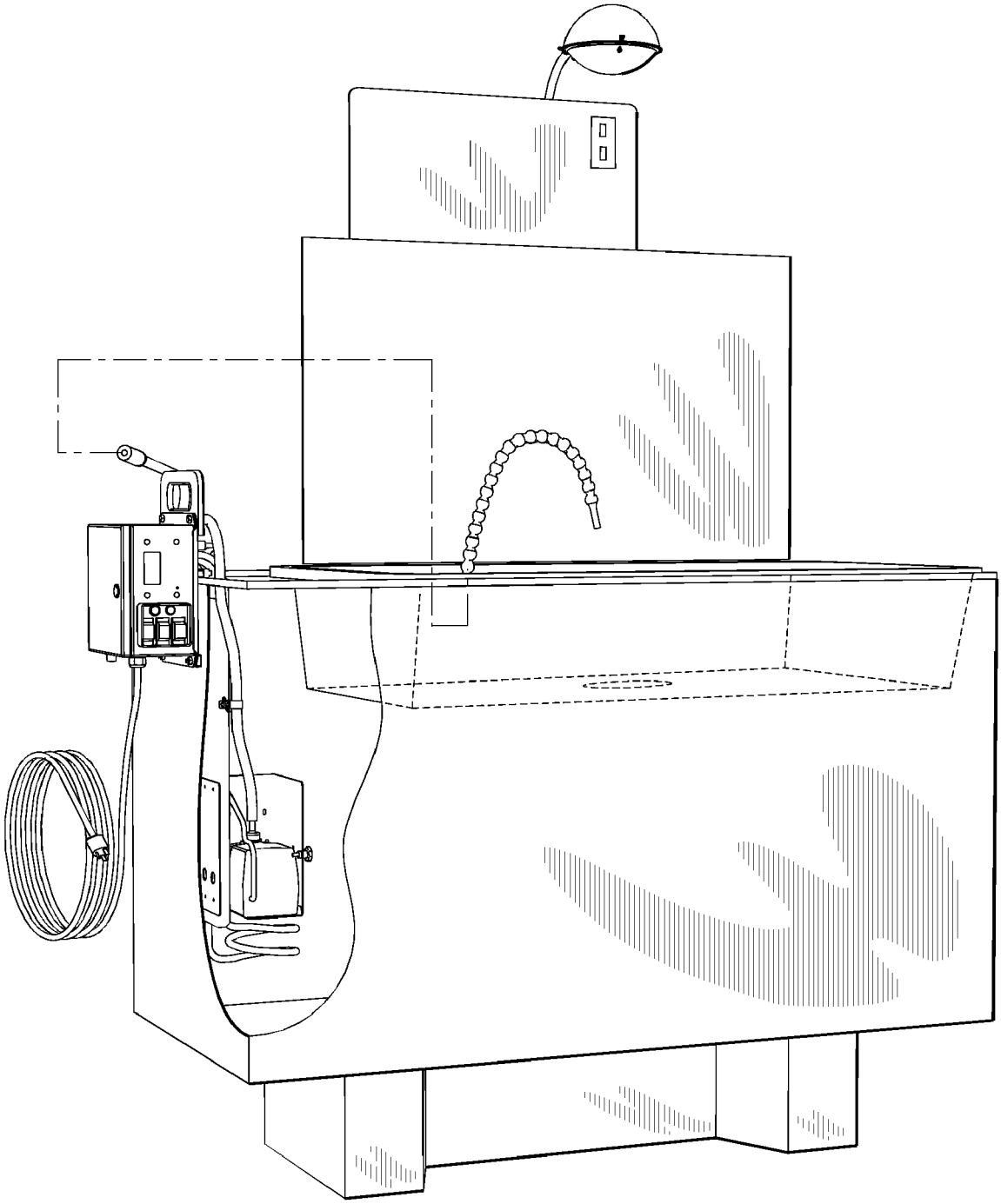
FIG. 6 is a perspective view of an improved parts washer with a rectangular reservoir constructed in accordance with another embodiment of the present disclosure.

The receptacle 1 shown in FIG. 1 may be a commercial sink made of stainless steel, plastic, or other robust material. The receptacle 1 may include plural, preferably tapered sidewalls 5, an upper peripheral margin 6, and a rear margin 7 of increased width to which a back wall 4 may be attached. A light 8 may be used to help the operator (not shown) during parts washing. While a receptacle 1 of rectangular geometry with a flat bottom section is shown in FIG. 1, but what is contemplated is any receptacle 1 of any useful geometry designed to hold a cleaning fluid in accordance with the principles of this disclosure. FIG. 6 is a perspective view of an improved parts washer with a rectangular reservoir constructed in accordance with another embodiment of the present disclosure. What is also shown is the use of a light 8 and a back wall 4 attached to the receptacle 1 to transform the receptacle area into a work area where an operator (not shown) can clean parts with improved visibility. In one preferred embodiment, the back wall 4 is attached to the receptacle 1 using hinges, but other types of fixation devices including but not limited to clips, welds, slide rails, bolts, etc. are also contemplated. What is also contemplated is any type of device or system used in work areas, including but not limited to a work area with different elements for holding and storing tools and documents, storing or using secondary cleaning products, communication devices, and control terminals for operation of the parts washer or management of work performed in the work area.

The drain (not shown) between the receptacle 1 and the reservoir 2 is implied within the definition of the receptacle 1 or sink. Any type of drain (not shown), including a plug or other drain restriction or drain filtration device, is contemplated. What is also contemplated is the use of racks, strainers, holders, and curvatures made in the receptacle 1 to manage the use of the cleaning fluid 3 within the receptacle 1. By way of nonlimiting example, what is also contemplated is the use of lateral slits as drains made at a certain height within the receptacle 1 to maintain a volume of cleaning fluid at the bottom or the receptacle 1 where parts can be soaked. What is also contemplated is any system where cleaning fluid is brought from the reservoir using a pump 10 or other device to displace the cleaning fluid 3 from the reservoir 2 to the receptacle area and ultimately drained through a drain (not shown) in the receptacle 1 back into the reservoir 2 by gravity after a brief controlled passage within the receptacle 1.

The cleaning fluid 3 is pushed up by a pump 10 from the reservoir 2 to the receptacle area and ultimately to a part (not shown) to be cleaned by an operator. Once the cleaning fluid 3 is released into the receptacle area, the cleaning fluid is used to clean a part and subsequently flows down by gravity through the drain back into the reservoir 2. FIG. 2 of U.S. Pat. No. 7,040,161 (incorporated herein by reference) shows a contemplated example associated with the methods of controlling the flow of cleaning fluid from the reservoir 2 to the receptacle 1. This figure shows the device where a user-selectable valve is used along with a hose connector and brush. FIG. 1 of the current disclosure shows a configuration where the connection between end 11 of the output hose 9 of the pump 10 is not connected to any user-controlled valve. While one possible embodiment is shown where the end 11 of the output hose 9 must be attached to the flow control device, such as a nozzle, a user-selectable valve, a hose, or any other type of connector, it is understood by one of ordinary skill in the art that the use of any configuration where a pump 10 moves cleaning fluid to an output hose 9 may be used.

The parts washer module 200 as illustrated in FIG. 1 is attached to the interface between the reservoir 2 and the receptacle 1. It is understood that the parts washer module 200 comprises a handle 12 for handling, holding, raising, and securing the parts washer module 200 in place. In one embodiment as shown in FIG. 1, the parts washer module 200 is attached to the reservoir 2 in a counterweight fashion. A first portion of a frame 13 of the parts washer module 200 equipped with the pump 10, the heating element 15, and the liquid level detector 16 as shown in FIG. 2 is placed inside of the reservoir 2 and is in contact with the cleaning fluid 3. Absent a counterweight, the frame 13 would be able to move within the reservoir 2. To stabilize the frame 13, the control module 14 is attached to a second section of the frame 13 located outside of the reservoir 2. Any displacement of the inner or outer sections of the frame 13 must correspond to an associated displacement of the other counterweight section. For example, if the command module is lifted at its base from the interface between the reservoir 2 and the receptacle 1, then the pump is blocked internally by the reservoir 2. While one method of fixation and stabilization of the frame 13 is shown, what is contemplated within the scope of this disclosure is any method of fixing the frame 13 or of the different constituents of the parts washer module 200 on the reservoir 2, including but not limited to vertical supports, radial supports, mechanical fixation means, or use of a reservoir with fixation openings, magnets, clamps, etc.

Figure 4:
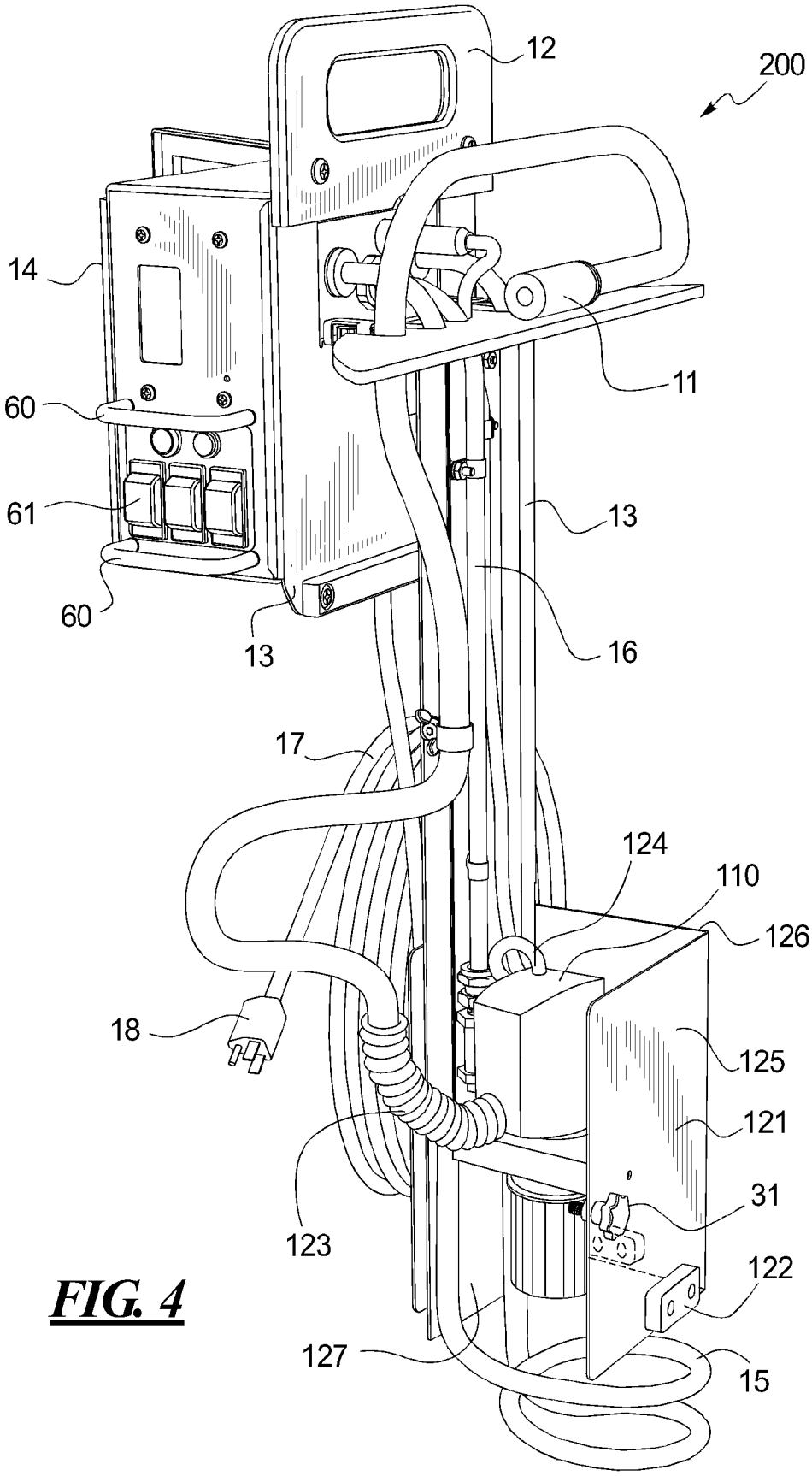
FIG. 4 is a perspective view of an improved parts washer module according to a second embodiment of the present disclosure equipped with a pump having a horizontal outlet and a vertical inlet.
Figure 5:
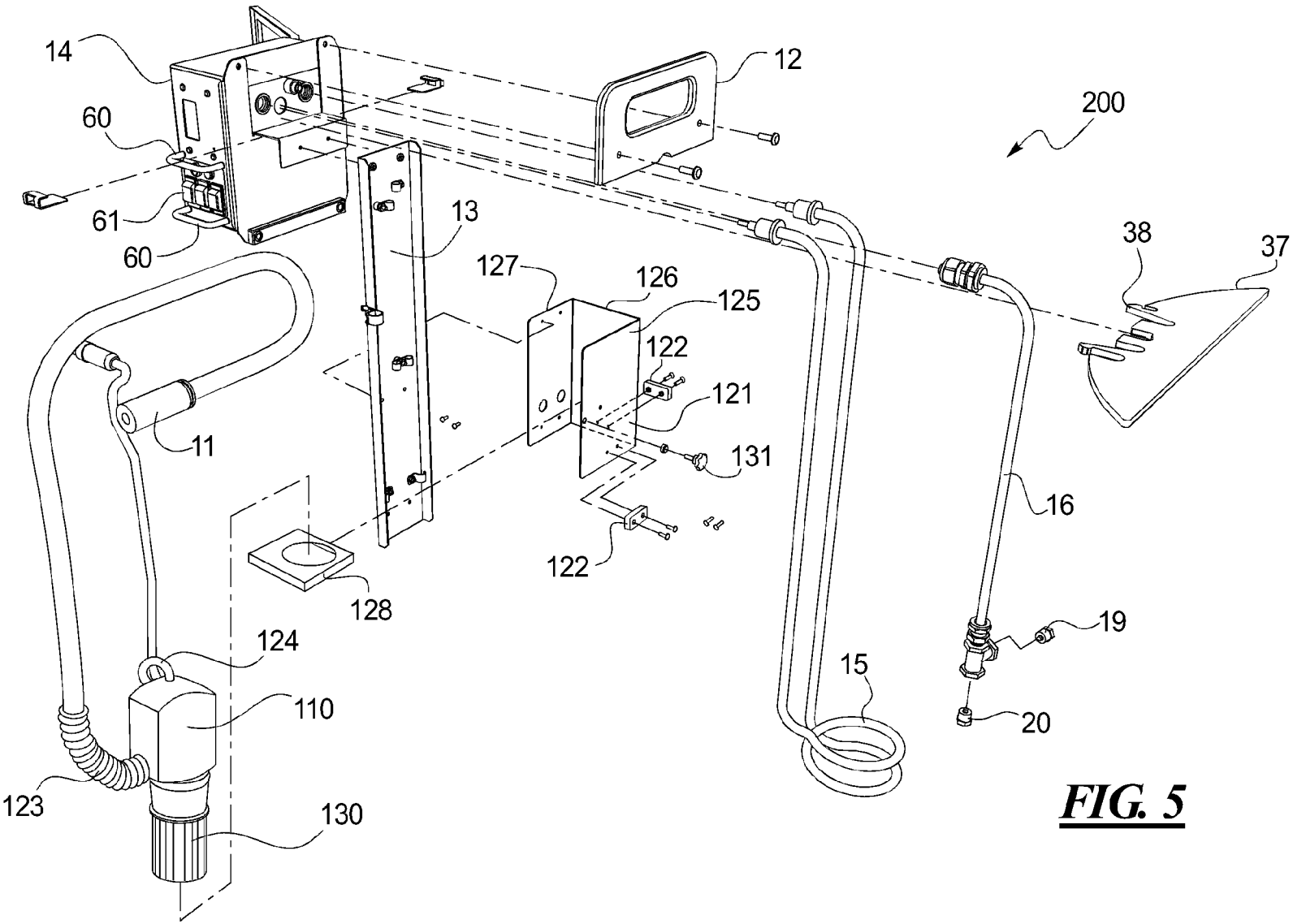
FIG. 5 is an exploded view of the improved parts washer module as shown in FIG. 4 according to a second embodiment of the present disclosure.

FIGS. 1-3 illustrate one possible type of pump 10 for moving the cleaning fluid 3 from the reservoir 2 to the receptacle 1 at a flow rate. FIGS. 4-5 illustrate a second possible embodiment where the pump 110 is designed to move the cleaning fluid 3 from the reservoir 2 to the receptacle 1 at a flow rate. While two different types of pumps 10, 110 are shown, what is contemplated is the use of any type of pump able to move the cleaning fluid 3 from the reservoir 2 to the receptacle 1. FIG. 3 is an exploded view of the pump 10 with a pump outlet 23 located above the pump 10 and an electrical connection 24 located in the back of the pump 10 shown in FIG. 3 as the front of the illustration. The front of the pump being defined as the face with an fluid inlet encaged in a plenum defined by the protective guard 21 and the pump 10. FIG. 5 is an exploded view of the pump 110 with a pump outlet 123 located on the front of the pump 110 and an electrical connection 124 located on top of the pump 110. Both types of pumps 10, 110 may be equipped in the preferred embodiments with a protective guard 21, 121, shown as a C-shaped metal casing with a front wall 25, 125, a back wall 26, 126, and a fixation wall 27, 127. The pump 10 in FIG. 3 is held by a lower plate 28, while the pump 110 in FIG. 5 is held by an intermediate plate 128. Both plates 28, 128 serve to hold the pumps 10, 110 while allowing the cleaning fluid 3 access to the pump inlet (not shown). A filter 130 is shown in FIG. 5, which protects the pump inlet from large debris and other particles suspended in the cleaning fluid 3. An indirect filter is created in the plenum area in front of the pump 10 at the inlet by the volume contained within the protective guard 21 and the lower plate 28. Pump 10 is horizontally oriented with a vertical outlet 23 and a horizontal inlet (not shown). Pump 110 is vertically oriented with a vertical inlet and a horizontal outlet 123.

One difference between the pumps, based solely on the respective geometries of the pumps 10, 110 compared to the protective guards 21, 121, is the placement of magnetized blocks 22, 122 located outside the protective guard 21, 121 as shown in FIGS. 3 and 5. What is shown is only one possible embodiment, and what is contemplated is the placement of magnetized blocks 22, 122 in the passage of the cleaning fluid 3 next to the pump inlets (not shown) outside of the protective guard 21, 121. The use of magnetized blocks 22, 122 allows for the collection of magnetized particles or materials with magnetic properties suspended in the cleaning fluid 3, such as chips of metal and the like. The magnetized blocks as shown in FIGS. 3 and 5 are fixed by screws in one preferred embodiment, but any method of fixation, including but not limited to slide rails, clips, magnetized surfaces, adhesives, welds, bolts, etc. is contemplated. In one preferred embodiment, the protective guard 21 is also equipped with a lower plate 28 with slide rails to be used in conjunction with a securing screw 31 also called a securing knob. This system allows for displacement of the pump 10 inside of the protective guard 21 in order to create a plenum area where cleaning fluid to be pumped can flow absent debris. The intermediate plate 128 of pump 110 as shown in FIG. 5 includes an opening to allow for the bottom section of the pump and the filter 130 to pass unobstructed.

FIG. 3 also illustrates the liquid level detector 16 disposed within the reservoir 2 for generating a first signal, generally an electrical signal using a first sensor 19, when the cleaning fluid 3 shown in FIG. 1 is disposed at least at a predetermined level generally associated with the position of the first sensor 19 on the liquid level detector 16. In one embodiment, the first sensor 19 is located at an intermediate junction, and the second sensor 20 is located at a lower end on the liquid level detector 16. In one embodiment, the second signal is generated when the cleaning fluid 3 is disposed below the first predetermined level below this level. The control module 14 is connected to the pumps 10, 110 and to the liquid level detector 16 for receiving one of the first and second signals from the sensors 19, 20. The control module 14 allows the pump 10, 110 to work in a pulsating fashion and create a pulsating flow of cleaning fluid 3 in the receptacle 1 upon reaching the first or second sensors 19, 20 on the liquid level detector 16. Both the first and second sensors 19, 20 are also able to monitor the level of the cleaning fluid 3 in the reservoir to turn off the heating element 15 if the cleaning fluid 3 reaches a low level where the heating element 15 can sustain damage by not being sufficiently submerged. In one preferred embodiment, the pumps 10, 110 pulsate to create an artificial variability of the flow rate. In yet another preferred embodiment, the liquid level detector is a commercial thermistor. In yet another preferred embodiment, the liquid level detector 16 includes a pair of thermistors oriented on intersecting axes on a T-shaped head.

The use of the pump 110 in a vertical orientation as shown in FIGS. 4-5 allows for the preferential pumping of the top layers of cleaning fluid 3, which are less subject to high content of dirt or other particles in suspension. The pump 10 while horizontal draws from the plenum used with the lower plate 28 to draw only the top layer of the cleaning fluid 3 or draw fluid from upper layers that may flow from the back of the pump 10 to the front of the pump 10.

In one alternate embodiment, interface plate 37 is connected to the interface between the reservoir 2 and the receptacle 1 as shown in FIGS. 3 and 5, respectively, to prevent evaporation of the cleaning fluid 3 located inside the reservoir 2. The interface plate 37 may be snapped or locked in place either on the parts washer module 200 or at that interface between the reservoir 2 and the receptacle 1. FIGS. 3 and 5 show the use of locking arms 38 that allows the interface plate 37 to be inserted and locked into position. What is also shown is the removal of part of the outer section of the interface plate 37 to allow for the passage in a preferred embodiment of the heating element 15 and the liquid level detector 16. In the preferred embodiment, the interface plate 37 is in the shape of a segment of a circle, but it is understood by one of ordinary skill in the art that the shape of the interface plate 37 is based on the interstitial opening space created at the junction of the reservoir 2 and the receptacle 1. What is also contemplated is the use of other interface plates located in other orientations around the receptacle in the eventuality that other interstitial openings between the reservoir 2 and the receptacle 1 are present. It is understood by one of ordinary skill in the art that what is contemplated by way of this disclosure is the use of interface plates to prevent evaporation of the cleaning fluid 3 from the reservoir 2. In yet another embodiment, a marking, such as the word "top," is used to distinguish between the upper surface of the interface plate and the lower surface of the interface plate. But it is understood that any marking in any language including symbols, pictograms, and other recognizable markings may be used.

In yet another embodiment, the frame 13 includes a pump 10 disposed in the reservoir 2 and connected to the frame 13 for moving the cleaning fluid 3 from the reservoir 2 to the receptacle 1 at a flow rate, a heating element 15 disposed within the reservoir 2 and connected to the frame 13 in fluid contact with the cleaning fluid 3 in the reservoir 2 for heating the cleaning fluid, and a control module 14 comprising in one embodiment a pair of handlebars 60 as shown in FIGS. 2 and 4 and a series of controls 61 for activating the lamp 8, the heating element 15, and the pump 10, wherein the handlebars 60 are disposed adjacent the series of controls 61 to protect the series of controls 61 from impact. In yet another embodiment, the control module 14 comprises one handlebar 60, which act as roll-bar, which may also be used to handle the parts washer 100 or the parts washer module 200. The handlebars 60 may also be molded within the casing of the control module 14. In yet another embodiment, instead of handlebars 60, what is contemplated is the use of molded edges made in the control module 14 casing to protect the series of controls 61. While one possible method of protection is shown and illustrated, what is contemplated is the use of any device either built-in or added that allows the series of controls 61 to be protected from impact.

FIG. 1 also shows the heating element 15 used to heat the cleaning solution 3 within the reservoir 2, the heating element 15 being made of a single-coil heater connected to the control module 14 and curved to provide better heating locally at the input (not shown) of the pump 10.

These improvements include but are not limited to the use of magnets located near a pump inlet to collect metallic particles suspended in the cleaning fluid, which metallic particles are capable of damaging the inside of the pump during circulation; a casing to protect the pump mechanism from impact during handling and to create a plenum area; a horizontal orientation of the pump to take advantage of the separation of the cleaning fluid in successive vertical layers or the use of a vertical orientation pump that acts with a plenum area to take advantage of the separation of the cleaning fluid in successive vertical layers; the use of two liquid level sensors to measure the level of the cleaning fluid in the reservoir and ultimately control the heating element; an evaporation control plate located at the upper rim of the reservoir to confine the vapor portion of the cleaning solution; protective handlebars placed next to the controls of a control module or molded edges in the protective casing of the control module to protect the device from impact; and a segmented pump motor control to create a pulsating flow to warn a user of a low level of cleaning fluid within the reservoir.

It is understood by one of ordinary skill in the art that while these elements and steps correspond to the elements required to practice the inventions of this disclosure, other auxiliary elements may be taken to perform these improvements but do not affect the validity and completeness of the disclosure of this general disclosure. Persons of ordinary skill in the art appreciate that although the teachings of the disclosure have been illustrated in connection with certain embodiments, there is no intent to limit the invention to such embodiments. On the contrary, the intention of this application is to cover all modifications and embodiments falling fairly within the scope of the teachings of the disclosure.

What is claimed is:

1. A parts washer, comprising:

a reservoir for holding a cleaning fluid at a level;

a receptacle connected on the reservoir;

a drain defined in the receptacle for fluid communication between the receptacle and the reservoir;

a frame connected to the reservoir;

a guard connected to the frame including a front wall, a back wall, and a lower plate;

a pump connected to the lower plate to thereby define a plenum volume between and among the pump, the front wall, the back wall, and the lower plate and to a control module;

a pump inlet in direct communication with the plenum volume so that the pump when activated by the control module moves the cleaning liquid from the plenum volume to the receptacle at a flow rate;

a heating element disposed within the reservoir and connected to the frame for adjusting a temperature of the cleaning fluid;

a liquid level detector assembly disposed within the reservoir and having an upper end connected to the control module, a lower end disposed adjacent the pump, an intermediate junction disposed between the upper end and the lower end, a first sensor connected to the intermediate junction that generates a first signal representative of a first temperature of the cleaning fluid when the level of the cleaning fluid is at or above the first sensor and a second sensor connected to the lower end that generates a second signal representative of a second temperature of the cleaning fluid when the level of the cleaning fluid is at or above the second sensor; and the control module connected to the frame, the first sensor for receiving and monitoring the first signal generated by the first sensor and the second sensor for receiving and monitoring the second signal generated by the second sensor;

wherein the control module includes a processing unit and a memory that stores programming instructions, that when read by the processing unit causes the control module to function to determine a position of the level by comparing the first signal to a first set point and the second signal to a second set point.

2. The parts washer of claim 1, wherein the control module further functions according to programming instructions to indicate an initial low level position defined by the level disposed between the lower end and intermediate junction by successively alternately activating and deactivating the pump in order to adjust the flow rate when the first signal is greater than the first set point and the second signal is equal to or less than the second set point.

3. The parts washer of claim 2, wherein the pump comprises a motor, a fluid inlet, a casing, and a protective guard.

4. The parts washer of claim 2, wherein the activation and deactivation of the pump is made in a pulsating mode.

5. The parts washer of claim 3, wherein the pump and the fluid inlet are vertically oriented.

6. The parts washer of claim 3, further comprising a particle filter with a plurality of openings for contact of the cleaning fluid with the reservoir with the fluid inlet.

7. The parts washer of claim 3, wherein magnetized elements are used for filtering of any metallic particles suspended in the cleaning fluid.

8. The parts washer of claim 7, wherein the magnetized elements are located on the protective guard.

9. The parts washer of claim 2, wherein the protective guard is made of stainless steel.

10. The parts washer of claim 2, wherein the a plenum volume is a retention and filtration zone.

11. The parts washer of claim 1, wherein the position of the level is disposed at an initial low level position defined by the level disposed between the lower end the intermediate junction when the first signal is greater than the first set point and the second signal is equal to or less than the second set point.

12. The parts washer of claim 1, wherein the first and second sensors are thermistors.

13. The parts washer of claim 1, wherein the lower end and the intermediate end are located at adjacent ends of a T-shaped connector.

14. The parts washer of claim 1, wherein an interface plate is connected to the control module and disposed at an interface between the reservoir and the receptacle for preventing evaporation of the cleaning fluid located inside the reservoir.

15. The parts washer of claim 14, wherein the interface plate is snapped locked to the control module.

16. The parts washer of claim 14, wherein the interface plate is in the shape of a segment of a circle.

17. The parts washer of claim 14, wherein a marking is used to distinguish between the upper surface of the interface plate and the lower surface of the interface plate.

18. The parts washer of claim 1, wherein:

the control module further comprises at least one protection disposed adjacent a series of controls for controlling the flow rate, to protect the series of controls from impacts.

19. The parts washer of claim 18, wherein the at least one protection is two handlebars.

20. The parts washer of claim 18, wherein the at least one protection is an outer edge in a casing of the control module.

21. The parts washer of claim 19, wherein the two handlebars act as roll-bars to protect the series of controls.

22. The parts washer of claim 18, wherein the at least one protection is used to handle the parts washer.

* * * * *